United States Patent [19]

Widener

[11] Patent Number: 4,659,277

[45] Date of Patent: Apr. 21, 1987

[54] UNSTABLE LOAD STABILIZING AND HANDLING ATTACHMENT

[76] Inventor: Lloyd Widener, P.O. Box 11048, Charleston Htgs., S.C. 29415

[21] Appl. No.: 803,553

[22] Filed: Dec. 2, 1985

[51] Int. Cl.[4] ..... B66F 9/18

[52] U.S. Cl. ..... 414/607; 294/67.22; 294/88; 294/104; 414/622; 414/785; 414/918; 191/12.2 R

[58] Field of Search ..... 414/607, 622, 618, 619, 414/620, 621, 622, 785, 731, 740, 744 A, 918; 294/67.22, 88, 104; 191/12.2 R

[56] References Cited

U.S. PATENT DOCUMENTS

| | | | |
|---|---|---|---|
| 2,772,800 | 12/1956 | Brady . | |
| 2,873,874 | 2/1959 | Bestetal | 414/622 |
| 2,875,912 | 3/1959 | Thresher . | |
| 3,104,772 | 9/1963 | Mariotti . | |
| 3,164,405 | 1/1965 | Lull . | |
| 3,302,809 | 2/1967 | Eaves | 414/622 |
| 3,409,157 | 11/1968 | Lull | 294/67.22 X |
| 3,773,202 | 11/1973 | Dutra . | |
| 3,797,684 | 3/1974 | Brandt | 414/607 X |
| 3,817,567 | 6/1974 | Lull | 294/88 |
| 4,219,300 | 8/1980 | McMillan . | |
| 4,266,819 | 5/1981 | Pemberton . | |
| 4,395,188 | 7/1983 | Kaup . | |
| 4,529,239 | 7/1985 | Ogawa | 414/622 X |

FOREIGN PATENT DOCUMENTS

| | | | |
|---|---|---|---|
| 1125352 | 3/1962 | Fed. Rep. of Germany | 414/621 |
| 1933328 | 2/1971 | Fed. Rep. of Germany | 414/918 |
| 189812 | 10/1963 | Sweden | 294/104 |

*Primary Examiner*—Frank E. Werner

*Attorney, Agent, or Firm*—Hall, Myers & Rose

[57] ABSTRACT

Provided herein is a forklift attachment which is easily assembled and disassembled from the forklift including a mounting bracket, two independently pivotable, hydraulically actuated arms pivotally connected to the bracket where the arms are positioned to cooperate with the forklift tines, two hydraulic jacks one each associated with and pivotally connected to each arm and pivotally connected to the bracket to rotate themselves and cause rotation of the arms when actuated, and a hydraulic fluid and control system adapted to prevent obstruction of forklift operations and to permit independent actuation of the arms.

10 Claims, 5 Drawing Figures

UNSTABLE LOAD STABILIZING AND HANDLING ATTACHMENT

TECHNICAL FIELD

This invention relates to forklift attachments and more particularly a grapple device for manipulating unstable loads of a non-uniform size.

BACKGROUND OF THE INVENTION

Attachments for forklifts are well developed in the art and encompass many purposes. For example, attachments for assisting in the manipulation and movement of large objects such as logs or barrels, which in and of themselves, possess structural integrity are illustrated in publications such as U.S. Pat. Nos. 4,266,819 featuring vertically movable grapple arms, and 3,164,405 with a forwardly extending curved clamping member. Other attachments for stabilizing boxes or boxes on pallets during transport are illustrated in U.S. Pat. Nos. 2,272,800, a vertically movable load stabilizer means and 4,395,188, a horizontally adjustable load carrying attachment.

No doubt, these various illustrated devices and the others preceding those in the art perform quite adequately for their intended purpose. However, nowhere in the art is addressed an adjustable attachment for grappling and/or moving non-uniform, unstable loads of loose materials such as cardboard.

SUMMARY OF THE INVENTION

Accordingly, it is an object of this invention to provide an attachment for a forklift which permits normal operation of a forklift but also provide means for manipulating and securing loose, unstable stock materials with a conventional forklift.

It is another object of this invention to provide an attachment unit which is easily mounted to and disassembled from an industrial truck.

Yet another object of this invention is to provide an attachment which is disposed in front of a conventional forklift carriage and does not interfere with the function thereof.

Still another object of this invention is to provide a forklift attachment having independently actuable arms for clamping over the tines.

These objects are satisfied by the invention which provides an attachment for an industrial forklift truck having a standard vertically movable carriage including horizontal upper and lower beveled lips on the edge of its front plate, a hydraulic pump for pumping hydraulic fluid, and a pair of spaced, forwardly extending tines. The attachment comprises a mounting bracket which is connectable to the carriage to move vertically with the carriage and means for attaching said mounting bracket to the carriage, where the means engages the carriage along the upper and lower lips. The attachment also includes at least two yoke means integral with said mounting bracket; an arm pivotally connected to each of said yoke means where the arm is positioned to extend over and rotate onto one of the tines; and at least two boom means connected to and extending from said bracket in close proximity to each of said yoke means, and which are offset from the pivotal connection between said yoke means and said arm. Also included are hydraulic extendable/retractable jack means pivotally connected at one end to one of said boom means and at the other end to said arm where the jack means generally overlies a portion of the arm and is generally parallel to the arm and a hydraulic connection system between said hydraulic jack means and the hydraulic pump of the forklift truck, said hydraulic connection system including hoses extending from a control means to a connecting means attached to the carriage, hoses extending from said means to said jack means and a control means for simultaneous or independent actuation of each jack means. The apparatus allows actuation of said jack means, said jack extends or retracts, simultaneously pivoting said jack means relative to said arm and said boom and pivoting said arm about said yoke to rotate said arm relative to said carriage.

In operation, the grappling assembly contemplated by this invention permits an uneven load such as trash cardboard in a recycling facility to be manipulated with a conventional forklift truck. The attachment not only provides great assistance in open, unobstructed areas, but also contemplates operation in close confines such as the back of a refuse truck. Moreover, due to the characteristics of an unstable load in the context of processing operations, the instant invention provides a useful substitute for what heretofore have been virtually exclusive hand operations. In this context, the most notable use of the invention is the unjamming of a conveyor belt apparatus leading into a processing facility. Thus, the invention provides a quickly assembled and disassembled apparatus for an industrial truck with very flexible applications.

DETAILED DESCRIPTION OF THE ILLUSTRATED EMBODIMENT

Figure 1:
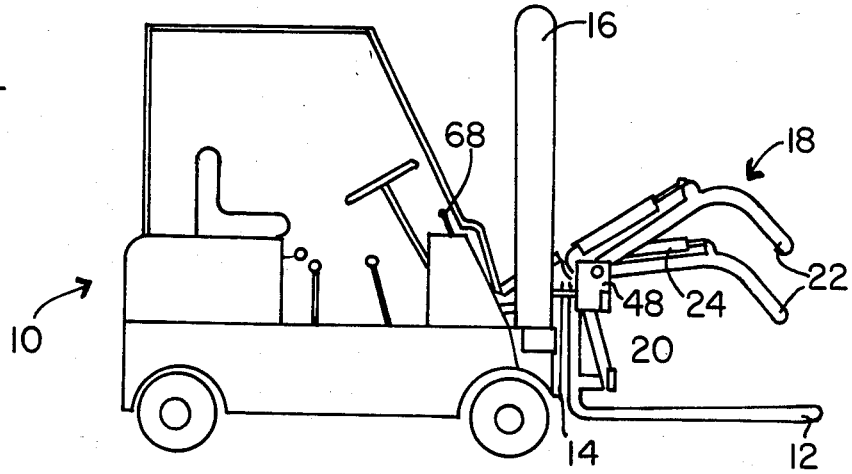
FIG. 1 is a depiction of one embodiment of the invention mounted on a conventional industrial truck.

FIG. 1 illustrates conventional industrial truck 10 having spaced horizontally projecting tines 12 extending from vertically adjustable load supporting carriage 14. Carriage 14 is a standard, Class 2 carriage which has a load bearing capacity generally ranging from 3,000 to 5,000 pounds. Carriage 14 translates vertically along tracks formed within vertical mast members 16 which again are of a conventional nature and powered by conventional means.

Grappling assembly 18, the invention, comprises two principal structural components; bracket support 20 and independently actuable, pivotally mounted arms 22. Assembly 18 is detachably mounted by bolts and clamping means to carriage 14 as described below. Bracket support 20 is mounted essentially on the front of carriage 14 so that assembly 18 is capable of vertical movement corresponding to that of the carriage when it is translated along masts 16 and the function of carriage 14 is not interfered with.

Arms 22 constitute a load stabilizing means which are capable of pivoting onto tines 12 for stabilizing a load supported by the tines. Arms 22 are independently actuable by separately controllable hydraulic cylinder jacks 24 associated with each. Also each arm 22 is essentially J-shaped so that when pivoted, it rotates from a position where the tip contacts near the end of the underlying corresponding tine 12, projects vertically therefrom for a distance and then parallels in a vertically spaced relation thereto.

Figure 2:
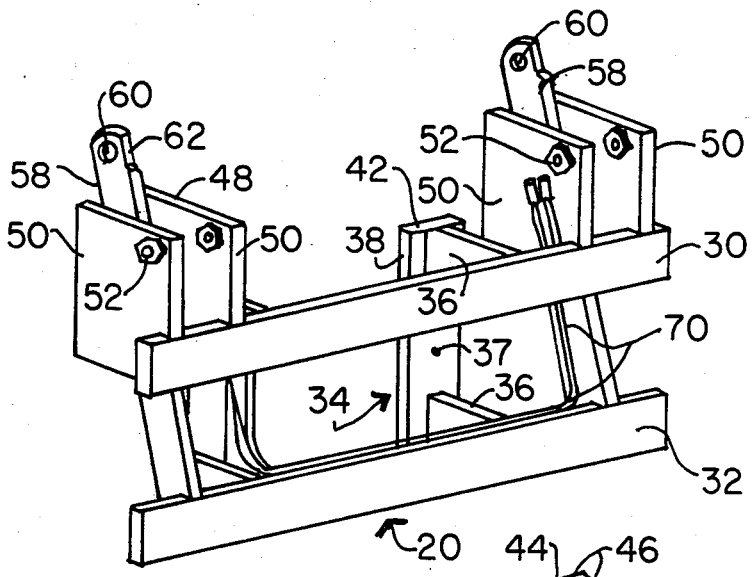
FIG. 2 is a perspective view of the mounting bracket assembly.

Turning now to FIG. 2, it illustrates bracket support 20 in greater detail. Support 20 features upper transverse bar member 30 and lower transverse bar member 32. Transverse bar members 30 and 32 are connected by welding to horizontally-spaced, vertically-disposed mounting members 34. Mounting members 34 include two horizontal trusses 36 superposed relative to each other and extending behind bar members 30 and 32. Welded to the back end of trusses 36 is vertical connector strut 38 to which trusses 36 are welded.

Figure 3:
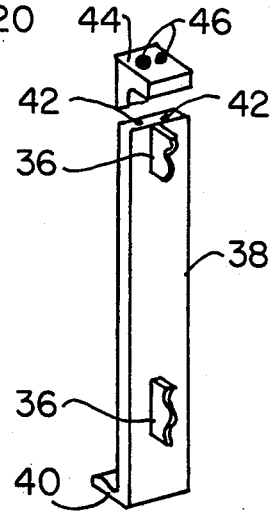
FIG. 3 is a perspective view of the vertical strut component.

Struts 38 feature hooks 40 (see FIG. 3) at their bottom which are designed to hook under the front plate of carriage 14. Conventional Class 2 carriages contain horizontal lips disposed along their upper and lower edges which are beveled toward the back of the carriage independently of the tines. Hook 40 is designed to mate with and engage the lower lip, preferably at a point proximate to and inside one of tines 12. Struts 38 also feature borehole 37 which is adapted to receive a bolt which passes through both strut 38 and a complementary hole in the vertically-disposed front panel of carriage 14. The purpose of hole 37 is to permit assembly 20 to be bolted to carriage 14 for further stabilization. To complete the mounting of bracket 20, the upper edge of strut 38 include two threaded bores 42 which receive beveled hooked coupling 44 to clamp over the upper lip of the carriage. Coupling 44 features bolts 46 which thread into bores 42 to affix coupling 44 to the top of strut 38. Therefore, bracket 20 is secured to carriage 14 by engaging hook 40 and beveled member 44 onto the lower and upper lips, respectively, of carriage 14 and securing a bolt through the front plate of carriage 14 and bore 37.

Focusing on the attachment of arms 22 and related equipment of mounting bracket 20, welded on the left and right ends of upper bar 30 are yoke assemblies 48. Each assembly incorporates two parallel, vertically disposed, horizontally spaced plates 50. Located near the upper front corners of each plate are circular apertures 52. These apertures incorporate bushings 54 which project from both sides of a plate 50. Each yoke assembly 48 provides a pivotal attachment for each arm 22 via pivot pin 56 (see FIG. 4).

Figure 4:
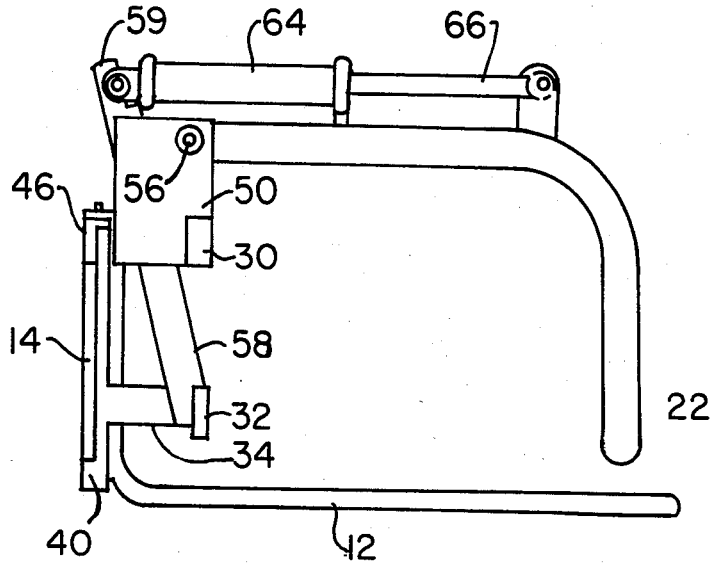
FIG. 4 is a partial side view of one embodiment of the invention attached to a forklift carriage.

Booms 58 are welded to lower transverse bar 32 projecting therebehind at an acute angle, between plates 50 at yoke assemblies 48 and above the upper edges thereof. Cylinder linkage holes 60 are formed at the upper curved end of booms 58 which also incorporate notches 62 for permitting linkage for the base end of a conventional hydraulic cylinder jack. Referring to FIG. 4, the structure of mounted assembly 18 is highlighted. Curved arm 22, illustrated in the "closed" position is pivotally mounted to yoke assembly 50 via pin 56. Hydraulic cylinder jack 64 including extendable/retractable piston 66 is pivotally bolted to boom 58 at one end and at the other to lug 68 extending from the upper edge of arm 22. Such connections are well known and known to those of ordinary skill in the art. Accordingly, no further elaboration is deemed necessary here. Also depicted in FIG. 4 is the bracket support 20 mounted to carriage 14 in the manner described above.

When it is desired to pivot arm 22, the hydraulic system, outlined below, is actuated. Hydraulic fluid causes piston 66 to translate through the housing of cylinder jack 64. If foreshortened, the translation causes arm 22 pivotally connected to yoke 50 by pin 56 to pivot away from tine 12. In order to achieve pivoting of arm 22 in this manner, it is necessary for cylinder jack 64 to be connected at a fixed pivot point offset from yoke 50. Hence, the purpose of pivot linkage 59 formed at the end of boom 58 with the base end of jack 64. Where the relative length of jack 64 is increased, arm 22 rotates oppositely and toward tine 12.

It should now be readily apparent that when each arm 22 is so linked and capable of independent actuation, the invention provides a means for grappling uneven and unsteady loads of even non-integral materials such as cardboard.

Figure 5:
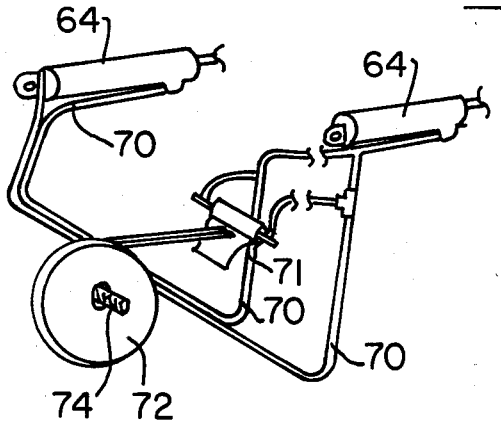
FIG. 5 is a schematic representation of the associated hydraulic hose system.

Moving briefly to the hydraulic system necessary to achieve the above described functions, it is depicted in FIG. 5. The overall system is substantially conventional and incorporates control unit 68 in the fork lift cab. This control unit is of a commercially available type which permits hydraulic fluid, pressurized by a pump associated with the forklift, to be passed to or removed from one or both of cylinder jacks 24. Hydraulic fluid hoses 70 extend from control unit 68 and are connected via connector 74 to commercially available hydraulic double swivel 71 like that sold by Arrow Forklift Company of Kansas City, Mo. Swivel 71 simply allows for the hoses to be properly moved with carriage 14 in a manner to prevent damage to the hoses. It has been found that the use of hose reel 72 connected to the forklift body and between the control unit and the swivel maintains the necessary length of hose during vertical movement of carriage 14 but prevents excess hose from getting caught in the apparatus or interfering with operations. Such units are known and commercially available from sources like that identified above. Accordingly, it is not deemed necessary to elaborate further on their particular structure.

The hydraulic hose assembly, consistent with other aspects of the invention, is positioned in a manner so as not to obstruct or interfere with normal operations of carriage 14.

Alternative embodiments of the invention are numerous. For example, two separate control units and hose assemblies, one for each arm 22 may be used. Arms 22 may be L-shaped and even toed-in depending on the particular intended use of assembly 18. Furthermore, bracket 20 may be constructed to be horizontally adjustable by having bars 30 and 32 constitute interfitting, telescoping members.

These and other embodiments should now be apparent to those of ordinary skill in the art and, as such, are intended to fall within the scope and spirit of the following claims.

I claim:

1. An attachment for an industrial forklift truck having a standard vertically movable carriage including a front plate with horizontal upper and lower beveled lips along its upper and lower edges, a hydraulic pump for pumping hydraulic fluid, and a pair of spaced, forwardly extending tines mounted on said carriage, comprising:

a mounting bracket, said bracket being connectable to the carriage to move vertically with the carriage; means for attaching said mounting bracket to the carriage independently of the tines, said means engaging the carriage along the upper and lower lips;

at least two yoke means integral with said mounting bracket; an arm pivotally connected to each of said yoke means, providing a linkage where said arm is positioned to extend over and rotate onto one of the tines;

at least two boom means connected to and extending from said bracket in close proximity to each of said yoke means, and offset from the pivotal connection between said yoke means and said arm, hydraulic extendable/retractable jack means pivotally connected at one end to one of said boom means and at the other end to said arm whereupon said jack means generally overlies a portion of said arm and is generally parallel to said arm;

hydraulic connection system between said hydraulic jack means and the hydraulic pump of the forklift truck, said hydraulic connection system including hoses extending from a control means to a connecting means attached to the carriage, hoses extending from said connecting means to said jack means and said control means being actuated for simultaneous or independent actuation of each jack means;

whereby upon actuation of said jack means, said jack extends or retracts, simultaneously pivoting said jack means relative to said arm and said boom and pivoting said arm about said yoke to rotate said arm relative to said carriage.

2. An attachment according to claim 1 where said connecting menas is a hydraulic hose storage means controls the length of hose extending between the carriage and the forklift truck.

3. An attachment according to claim 1 wherein said boom means is attached to the lower end of said bracket and projects through and above said yoke means.

4. An attachment according to claim 1 wherein said arms are curved so when rotated each contacts the respective tine near its end.

5. An attachment according to claim 1 where said connecting means is a dispenser.

6. An attachment according to claim 1 where said mounting bracket is forwardly mounted relative to the front plate, is adapted to have the tines project through the bracket, and is easily removable from the carriage.

7. An attachment according to claim 1 where said jack means is positioned above said arm and is pivotally connected thereto by an upwardly extending member on said arm.

8. An attachment according to claim 1 where said arms are J-shaped.

9. An attachment according to claim 1 where each arm lies entirely in the vertically plane defined by the underlying tine.

10. An attachment according to claim 1 where said linkage, hydraulic sytem and control means cooperate in a manner to provide the capability for independent pivoting of each arm relative to the underlying tine.

* * * * *